US006408571B1

(12) United States Patent
Trott

(10) Patent No.: US 6,408,571 B1
(45) Date of Patent: Jun. 25, 2002

(54) AUTOMATIC CLOSING GATE

(76) Inventor: Donald E. Trott, 1801 Archer Dr., Sherman, TX (US) 75092

( * ) Notice: Subject to any disclaimer, the term of this patent is extended or adjusted under 35 U.S.C. 154(b) by 0 days.

(21) Appl. No.: 09/704,853

(22) Filed: Nov. 2, 2000

(51) Int. Cl.[7] ..... E05F 13/00

(52) U.S. Cl. ..... 49/263; 49/236; 49/257; 49/381

(58) Field of Search ..... 49/21, 139, 140, 49/141, 236, 240, 241, 242, 243, 244, 245, 268, 271, 293, 294, 295, 296, 299, 394, 381, 501

(56) References Cited

U.S. PATENT DOCUMENTS 377,844 A * 2/1888 Bughman
440,853 A * 11/1890 Thompson
494,860 A * 4/1893 Hartley
518,743 A * 4/1894 Mason
583,036 A * 5/1897 Deutelbeck
656,812 A * 8/1900 Cockerill
1,769,195 A * 7/1930 Tenbrook
2,538,470 A * 1/1951 Peeples
2,786,289 A * 3/1957 Koch
2,799,103 A * 7/1957 Warren
3,377,746 A * 4/1968 Thomas
3,847,425 A * 11/1974 Kirk ..... 292/247
4,337,548 A 7/1982 Bonar ..... 16/311
4,472,908 A 9/1984 Wanzl et al. ..... 49/25
4,887,205 A 12/1989 Chou ..... 364/400
5,138,796 A 8/1992 Grainger ..... 49/238
5,282,336 A 2/1994 Tucker ..... 49/21
5,804,938 A 9/1998 Richmond et al. ..... 318/282
5,878,530 A * 3/1999 Eccleston et al. ..... 49/139
5,942,867 A * 8/1999 Richmond ..... 318/280

* cited by examiner

*Primary Examiner*—Curtis A. Cohen
(74) *Attorney, Agent, or Firm*—Sanford E. Warren, Jr.; Gardere Wynne Sewell LLP

(57) ABSTRACT

The present disclosure provides an automatic closing gate having a gate post and at least one self-closing hinge attaching the gate to the gate post. A catch post having a catch holds the gate in an open position for a period of time. The catch releases the gate after the period of time and the gate is free to swing shut.

9 Claims, 2 Drawing Sheets

AUTOMATIC CLOSING GATE

TECHNICAL FIELD OF THE INVENTION

This invention relates in general to the field of gates and, in particular to, a rural gate that closes an opening for vehicles or livestock in a fence and has a mechanism to automatically close the gate after a period of time.

BACKGROUND OF THE INVENTION

Without limiting the scope of the invention, its background will be described with reference to rural fence gates, as an example.

Since the early days of the cattle industry, cattlemen have built fences to protect and restrain their livestock. Countless ranch hands have strung thousands of miles of barbed wire to mark boundaries and corral the herd. They also inserted gates into the fences to allow passage from one fenced section to another.

The most basic gates were made by simply breaking the fence, usually at a corner, and securing the strands of wire to a free post. To close the gate, the lower end of the free post was placed in a loop of wire at the lower end of the corner post. The upper end of the free post was then pulled by hand or with a cheater bar until it was substantially vertical. The gate was secured with another loop of wire from the upper end of the corner post to the upper end of the free post.

Opening and closing a gate of this type is a time-consuming process. The gate lacks rigid structure after it is opened so it must be held by hand or laid on the ground while passing through. If laid on the ground, the gate may become tangled and possibly injure cattle. A man must also be left behind to close the gate, which can be a difficult task for a greenhorn. Another type of gate is a hinged gate. These may be made from wood or metal and are hinged at one end. As a farmer or rancher approaches the gate, he must stop his truck, open the gate, drive through the gate, stop the truck again, and finally close the gate. This process is only slightly improved if the driver has a passenger he can send out to open and close the gate.

If a farmer or rancher has several gates, this time-consuming and tedious process must be repeated many times every day. Weather conditions such as rain, sleet and snow only compound the misery of having to stop the truck and get out to close the gate.

One solution is to install an electric gate opener. These openers are complex and delicate. Their many parts may wear or fail in the outdoors. They also require a power supply, which may not be readily available in remote areas where gates are installed. Weather conditions and impacts from vehicles and livestock may also damage the electronic circuitry. These openers are also relatively expensive, which means that installing an electric opener on each gate on a ranch may not be economical.

Therefore, a need has arisen for a gate that a person can open and close without stopping the vehicle twice. A need has also arisen for such gate that is simple, robust and inexpensive.

SUMMARY OF THE INVENTION

The present invention disclosed herein provides an automatic closing gate having a gate post and at least one self-closing hinge attaching the gate to the gate post. A catch post having a catch holds the gate in an open position for a period of time. The catch releases the gate after the period of time and the gate is free to swing shut.

In one embodiment, a catch for a gate in an open position has an operation rod that releasably engages the gate. An actuator is coupled to the operation rod and operates to urge the operation rod out of engagement with the gate. The gate is free to swing shut after the operation rod disengages the gate.

In another embodiment, a method for automatically closing a gate includes the step of imparting potential energy to the gate while opening the gate. The gate is then releasably secured in an open position using a catch. The catch is set to release the gate after the period of time has expired.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1:
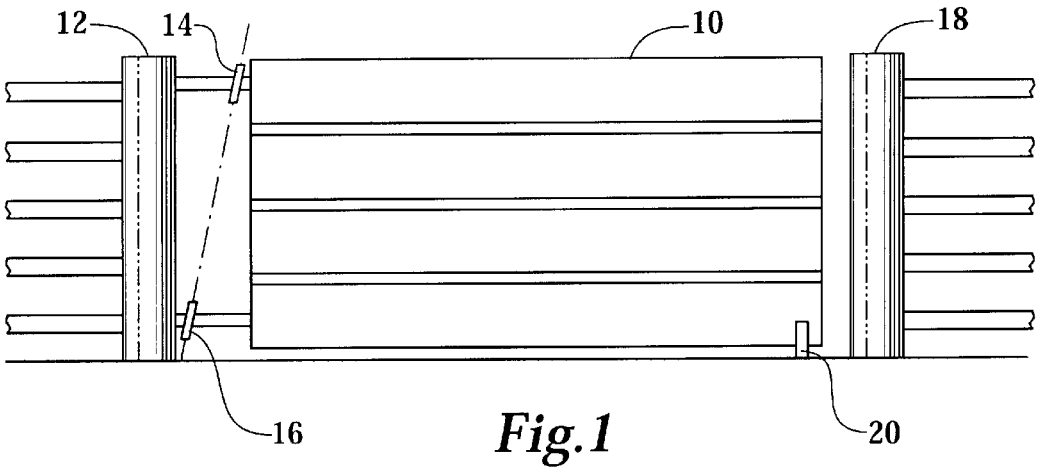
FIG. 1 is a front view of the gate in the closed position incorporating certain embodiments of the invention.

Referring now to FIG. 1, therein is depicted a front view of an automatic closing gate 10. The gate 10 may be hinged to a hinge post 12 using an upper hinge 14 and a lower hinge 16. A single, self-closing hinge may also be used. The gate 10 may be secured in the closed position by a lock 20.

The gate 10 may be an existing fence gate that is made of wood, aluminum or steel, for example. The upper hinge 14 and the lower hinge 16 may be offset hinges that pivot the gate 10 around an axis that may be offset from vertical. The upper hinge 14 and the lower hinge 16 may have unequal length hinge arms having hinge pins that are fixed at a similar angle, which is offset from vertical. This configuration causes the free end of the gate 10 to rise as the gate 10 is swung open in either direction. Potential energy is imparted to the gate 10 as the gate 10 is opened and the free end rises. This potential energy will swing the gate 10 to the closed position when the gate 10 is released.

The upper hinge 14 and the lower hinge 16 may also be self-closing hinges that are not mounted in an offset configuration. These self-closing hinges may be spring-loaded and urge the gate 10 to the closed position from the open position. Springs, cams, counterweights and the like may also be used to urge the gate 10 from the open position to the closed position. Other methods of making the gate 10 move from the open position to the closed position will be apparent to those having ordinary skill in the art.

Potential energy is imparted to the gate 10 as the gate 10 is opened. If the gate 10 is released in an open position, the weight of the gate 10 will tend to rotate the gate 10 to the closed position about the axes of the hinge pins of the upper hinge 14 and the lower hinge 16. Naturally, other types of self-closing hinges will also tend to rotate the gate 10 from the open position to the closed position.

Figure 2:
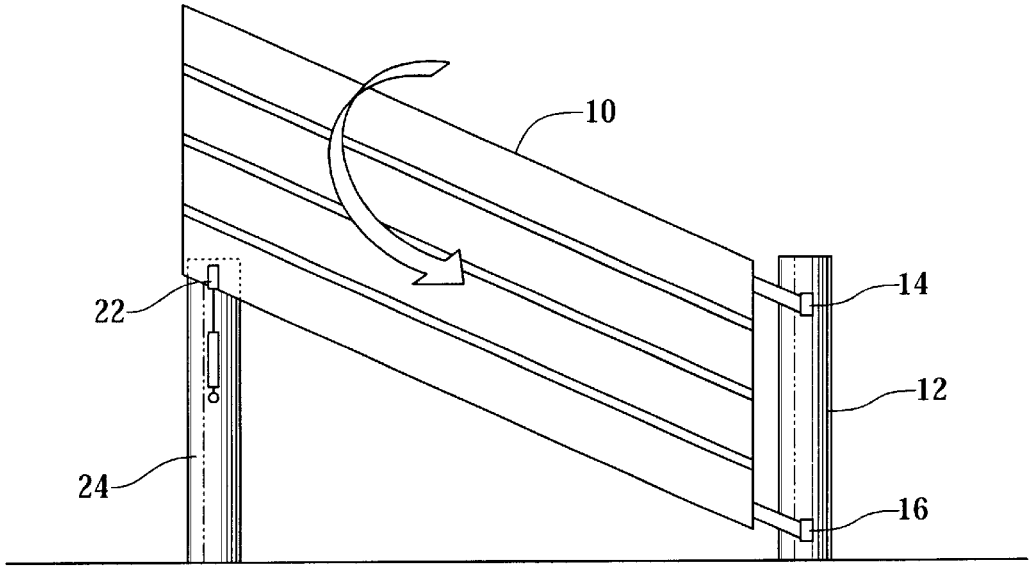
FIG. 2 is a side view of the gate in the open position incorporating certain embodiments of the invention.

A side view of the gate 10 in the opened position is depicted in FIG. 2. The gate 10 has been swung open about the hinge pins of upper hinge 14 and lower hinge 16. A user may operate a catch 22 on a catch post 24 to hold the gate 10 in the open position for a period of time. After the period of time has elapsed, the catch 22 releases the gate 10 and the gate 10 may swing to the closed position. In one embodiment of the invention, which will be described in greater detail below, the gate 10 may be automatically locked in the closed position.

The gate 10 may be opened by unlocking the free end of the gate 10. The gate 10 is then pushed open until it contacts the catch 22. The catch 22 may be manually set to retain the gate 10 for a period of time from a few seconds to several minutes, for example. The catch 22 may operate by a number of different mechanisms such as a ratchet, an electronic timer, counterweights, and the like.

Figure 3:
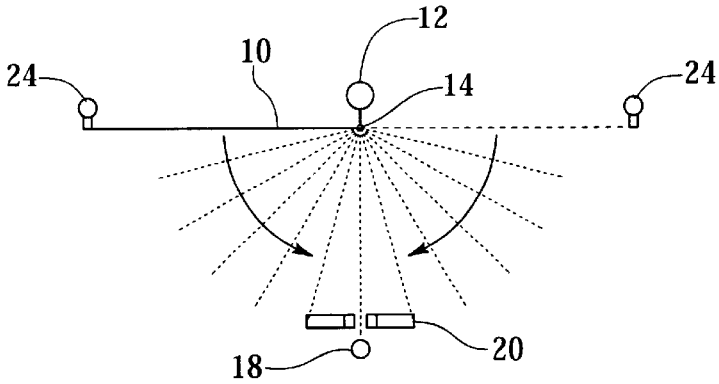
FIG. 3 is a top view of the gate assembly incorporating certain embodiments of the invention.

As best seen in FIG. 3, two catch posts 24 may be used to provide a self-closing gate that may be automatically closed from either side. This configuration may be useful if a gate must open in both directions. An additional catch post 24 and catch 22 may be installed on the opposite side of the gate 10. A farmer or rancher may open the gate 10 towards either direction, depending on which direction he is traveling.

Figure 4:
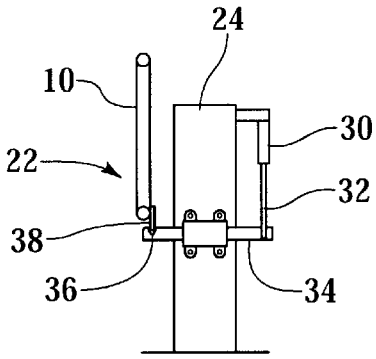
FIG. 4 is a detail side view of the catch assembly incorporating certain embodiments of the invention.
Figure 5:
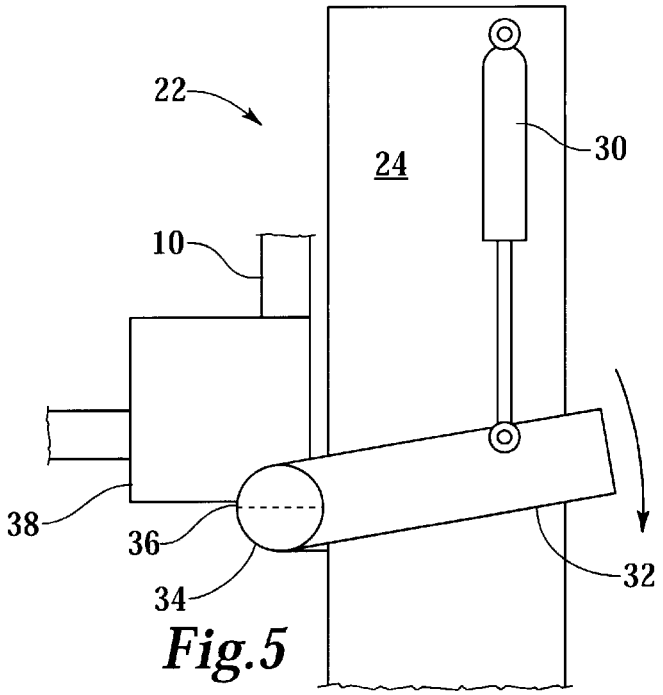
FIG. 5 is a detail front view of the catch assembly incorporating certain embodiments of the invention.

According to one embodiment of the invention depicted in FIGS. 4 and 5, the catch 22 may be operated by a piston 30. The piston 30 may be a pneumatic or hydraulic piston commonly used to close doors. One end of the piston 30 may be mounted to the catch post 24 and the other end of piston 30 may be connected to a timer handle 32. The timer handle 32 may have an operation rod 34, which holds the gate 10 in the open position. The gate 10 is released when the piston 30 pulls the operation rod 34 out of engagement with the gate 10.

Figure 6:
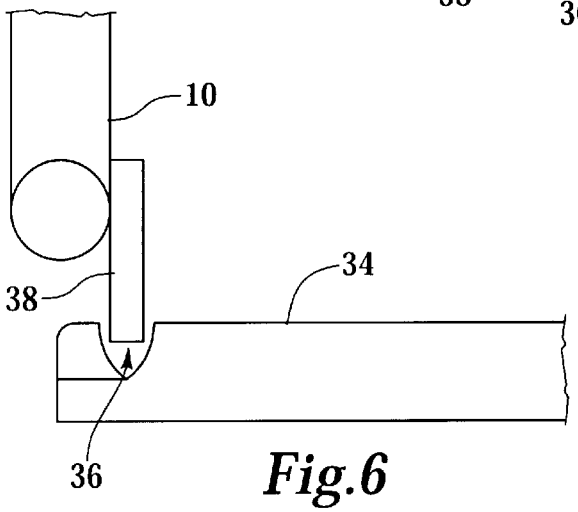
FIG. 6 is a detail side view of the catch assembly incorporating certain embodiments of the invention.
Figure 7:
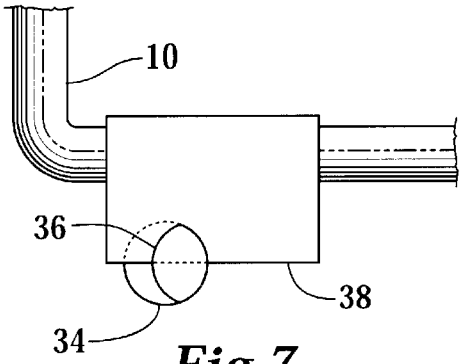
FIG. 7 is a detail front view of the catch assembly incorporating certain embodiments of the invention.

After the gate 10 has been opened, the timer handle 32 is operated to set the catch 22. Operating the timer handle 32 rotates the operation rod 34 to hold the gate 10. As best shown in FIGS. 6 and 7, the interface between the gate 10 and the operation rod 34 may include a catch notch 36 and a catch plate 38. As the timer handle 32 rotates the operation rod 34, the catch notch 36 rotates to capture an edge of the catch plate 38, which holds the gate 10 in the open position.

The catch notch 36 may be cut or machined from an end of the operating rod 34. In one embodiment, the catch notch 36 may be machined similar to a portion of a screw thread. As the catch notch 36 is rotated, the engaged edge of the catch plate 38 follows the partial thread and is held by the catch notch 36. Conversely, as the catch notch 36 rotates to release the gate 10, the catch plate 38 is "unscrewed" from the catch notch 36.

Figure 8:
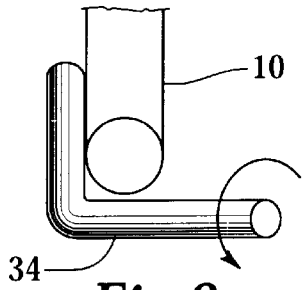
FIG. 8 is a detail side view of the catch assembly incorporating certain embodiments of the invention.

The catch plate 38 may be welded to the gate 10. The interface between the gate 10 and the operation rod 34 may also be a bend at the end of the operation rod 34 that directly engages the gate 10 and holds the gate 10 open, which is best shown in FIG. 8.

The rate of travel of piston 30 may be adjusted, according to a desired closing time delay. The delay may be of short duration to allow a single vehicle to pass through. A short delay is also helpful to deter livestock from passing through the gate 10 after a vehicle. A longer delay may be set if multiple vehicles must pass through the gate 10.

After the timer handle 32 is set and the gate 10 is held in the open position by the operation rod 34, the piston 30 begins acting on the timer handle 32. As the piston 30 retracts, the timer handle 32 may rotate the operation rod 34 until the gate 10 is released from the operation rod 34. If the catch notch 36 and the catch plate 38 are used, the catch notch 36 on the operation rod 34 is rotated out of engagement with the catch plate 38. When the catch plate 38 is free from the catch notch 36, the gate 10 is free to swing shut. The operation rod 34 release time may be delayed from a few seconds to several minutes according to how the piston 30 is adjusted.

After the catch 22 releases the gate 10, the offset orientation of the upper hinge 14 and the lower hinge 16 allows gravity to swing the gate 10 to the closed position. The gate 10 swings shut with enough force to overcome the resistance of the lock 20, which captures the free end of the gate 10 to secure the gate 10 in the closed position.

Figure 9:
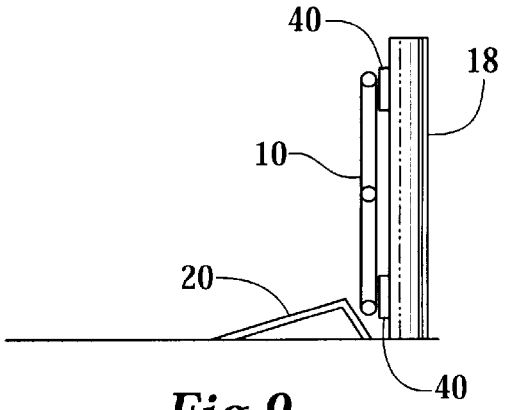
FIG. 9 is a detail side view of the gate lock assembly incorporating certain embodiments of the invention.

In one embodiment of the present invention, the lock 20 may be an automatic lock as depicted in FIG. 9. As the gate 10 swings to a closed position, the gate 10 has sufficient inertia to force the lower edge of the gate 10 up an inclined portion of the lock 20 and drop the lower edge of the gate 10 into a catch portion of the lock 20. A bumper 40 may be used to absorb the impact of the gate 10. The bumper 40 may be made from rubber, plastic, springs, and the like and installed on the locking post 18 or the lock 20. The gate 10 may be unlocked by simply lifting the free end of the gate 10 up and over the catch portion of the lock 20.

The lock 20 may also be a spring loaded mechanism that automatically captures a portion of the gate 10 as the gate 10 moves to the closed position. Components of the lock 20 may be configured to allow locking and releasing the gate 10 from either side of the fence. Other methods of locking gate 10 will be apparent to those having ordinary skill in the art.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. An automatic closing gate comprising:

a gate post;

a latch post for holding said gate in a closed position;

at least one self-closing hinge attaching the gate to the gate post; and a catch post having a means for holding the gate in an open position for a selectable period of time.

2. The automatic closing gate as recited in claim 1 further comprising a second catch post having a second means for holding the gate in a second open position for a second period of time.

3. The automatic closing gate as recited in claim 1 further comprising a lock to secure the gate in a closed position.

4. The automatic closing gate as recited in claim 1 wherein the period of time may be adjusted.

5. The automatic closing gate as recited in claim 1 wherein the means for holding the gate in an open position includes a piston.

6. A catch for securing a gate in an open position for a period of time, the catch comprising:

a catch post an operation rod rotatably mounted to catch post, said rod including a catch mounted on one end thereof for releasably engaging the gate;

a timer handle coupled to the other end of the rod, and an adjustable actuator coupled to the timer handle for urging the operation rod out of engagement with the gate.

7. The catch recited in claim 6 further comprising;

the timer handle and the actuator releasably engage the operation rod to the gate.

8. The catch recited in claim 6 wherein the period of time may be adjusted.

9. The catch recited in claim 6 wherein the actuator is a piston.

* * * * *